US008546693B2

(12) United States Patent
Gromko et al.

(10) Patent No.: US 8,546,693 B2
(45) Date of Patent: Oct. 1, 2013

(54) CABLE WITH TWISTED PAIRS OF INSULATED CONDUCTORS AND FILLER ELEMENTS

(75) Inventors: Michael Thomas Gromko, Greensboro, NC (US); Joseph Edward Geniac, Greensboro, NC (US); Keith Wayne Hoover, High Point, NC (US); Ralph S. Martin, Mount Airy, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 400 days.

(21) Appl. No.: 12/850,217

(22) Filed: Aug. 4, 2010

(65) Prior Publication Data

US 2012/0031643 A1 Feb. 9, 2012

(51) Int. Cl.
*H01B 11/02* (2006.01)

(52) U.S. Cl.
USPC ..... 174/113 R

(58) Field of Classification Search
USPC ..... 174/113 R, 113 C, 116
See application file for complete search history.

(56) References Cited

U.S. PATENT DOCUMENTS

| | | | | |
|---|---|---|---|---|
| 3,433,890 | A * | 3/1969 | Gabriel et al. | 174/116 |
| 3,678,177 | A * | 7/1972 | Lawrenson | 174/113 C |
| 4,131,757 | A * | 12/1978 | Felkel | 174/107 |
| 4,654,476 | A * | 3/1987 | Barnicol-Ottler et al. | 174/116 |
| 5,486,649 | A * | 1/1996 | Gareis | 174/36 |
| 5,574,250 | A | 11/1996 | Hardie et al. | |
| 6,342,678 | B1 | 1/2002 | Knop et al. | |
| 7,019,218 | B2 * | 3/2006 | Somers et al. | 174/113 R |
| 7,115,815 | B2 | 10/2006 | Kenny et al. | |
| 7,157,644 | B2 | 1/2007 | Lique et al. | |
| 7,238,885 | B2 | 7/2007 | Lique et al. | |
| 7,271,342 | B2 | 9/2007 | Stutzman et al. | |
| 7,271,343 | B2 | 9/2007 | Clark | |
| 7,317,163 | B2 | 1/2008 | Lique et al. | |
| 7,317,164 | B2 | 1/2008 | Lique et al. | |
| 7,329,815 | B2 | 2/2008 | Kenny et al. | |
| 7,390,971 | B2 | 6/2008 | Jean et al. | |
| 7,405,360 | B2 | 7/2008 | Clark et al. | |
| 2006/0131058 | A1 * | 6/2006 | Lique et al. | 174/113 R |
| 2006/0169479 | A1 * | 8/2006 | Dillon et al. | 174/113 R |
| 2007/0209823 | A1 * | 9/2007 | Vexler et al. | 174/113 C |
| 2008/0251276 | A1 * | 10/2008 | Clark et al. | 174/113 R |

* cited by examiner

*Primary Examiner* — Chau Nguyen

(57) ABSTRACT

A cable includes twisted pairs of insulated conductors. Each twisted pair includes two insulated conductors twisted together in a helical manner. The twisted pairs are grouped together to define a central core of the cable. An inner filler element is wrapped helically around the twisted pairs of the central core. An outer filler element is wrapped helically around the twisted pairs of the central core. The outer filler element is wrapped over the inner filler element.

17 Claims, 3 Drawing Sheets

CABLE WITH TWISTED PAIRS OF INSULATED CONDUCTORS AND FILLER ELEMENTS

BACKGROUND OF THE INVENTION

The subject matter described and/or illustrated herein relates generally to cables, and more particularly, to cables having twisted pairs of insulated conductors.

Some known data communication cables include pairs of insulated conductors that are twisted together to form a balanced transmission line. Such pairs of insulated conductors are commonly referred to as "twisted pairs." One example of a data communication cable includes multiple twisted pairs that are bundled and twisted, or cabled, together and covered with a jacket. Known problems with cables having twisted pairs include crosstalk. For example, when the twisted pairs within a cable are closely placed, electrical energy may be transferred between two or more of the twisted pairs within the cable. Further, crosstalk may occur between a twisted pair within a given cable and other items outside the cable, which is commonly referred to as "alien crosstalk". For example, alien crosstalk occurs when signal current in a twisted pair of one cable couples with a twisted pair of another cable. Crosstalk may increase the signal-to-noise ratio (SNR) and/or bit error rate (BER) of data communication cables.

Various cable designs have been used to attempt to reduce crosstalk and meet industry standards. Some cables include a central separator or filler for separating twisted pairs from each other and/or adding structural stability to the cable. Separation of the twisted pairs from each other may reduce the amount of crosstalk between the twisted pairs. However, the central separator or filler may undesirably increase a diameter of the grouping of twisted pairs within the cable, which may cause the twisted pairs to extend closer to other items outside the cable. Moreover, the central separator or filler adds to the construction costs and weight of the cable. The central separator or filler may also add more fuel in the case of fire, thus reducing or eliminating the ability of the cable to meet required fire safety standards.

Another attempt at reducing crosstalk includes positioning a filler between the twisted pairs and the cable jacket. The filler increases the distance between the twisted pairs and the jacket, thereby increasing the distance between the twisted pairs and other items outside the cable, such as a twisted pair of another cable. But, positioning a filler between the twisted pairs and the cable jacket may result in a cable having an oblong shape. Oblong cables may be more difficult to handle and/or may not fit through conventional circular cable openings within walls or panels through which the cable is intended to be fed.

Accordingly, some of the problems with at least some known data communication cables include an undesirably high amount of crosstalk between twisted pairs within the cable and/or between the twisted pairs of the cable and other items outside the cable.

BRIEF DESCRIPTION OF THE INVENTION

In one embodiment, a cable includes twisted pairs of insulated conductors. Each twisted pair includes two insulated conductors twisted together in a helical manner. The twisted pairs are grouped together to define a central core of the cable. An inner filler element is wrapped helically around the twisted pairs of the central core. An outer filler element is wrapped helically around the twisted pairs of the central core. The outer filler element is wrapped over the inner filler element.

In another embodiment, a cable includes twisted pairs of insulated conductors, wherein each twisted pair includes two insulated conductors twisted together in a helical manner. The twisted pairs are grouped together to define a central core of the cable. The cable also includes a first filler element wrapped helically around the twisted pairs of the central core, and a second filler element wrapped helically around the twisted pairs of the central core. The second filler element has a greater cross sectional size than the first filler element. A jacket at least partially surrounds the first and second filler elements and the central core.

DETAILED DESCRIPTION OF THE INVENTION

Figure 1:
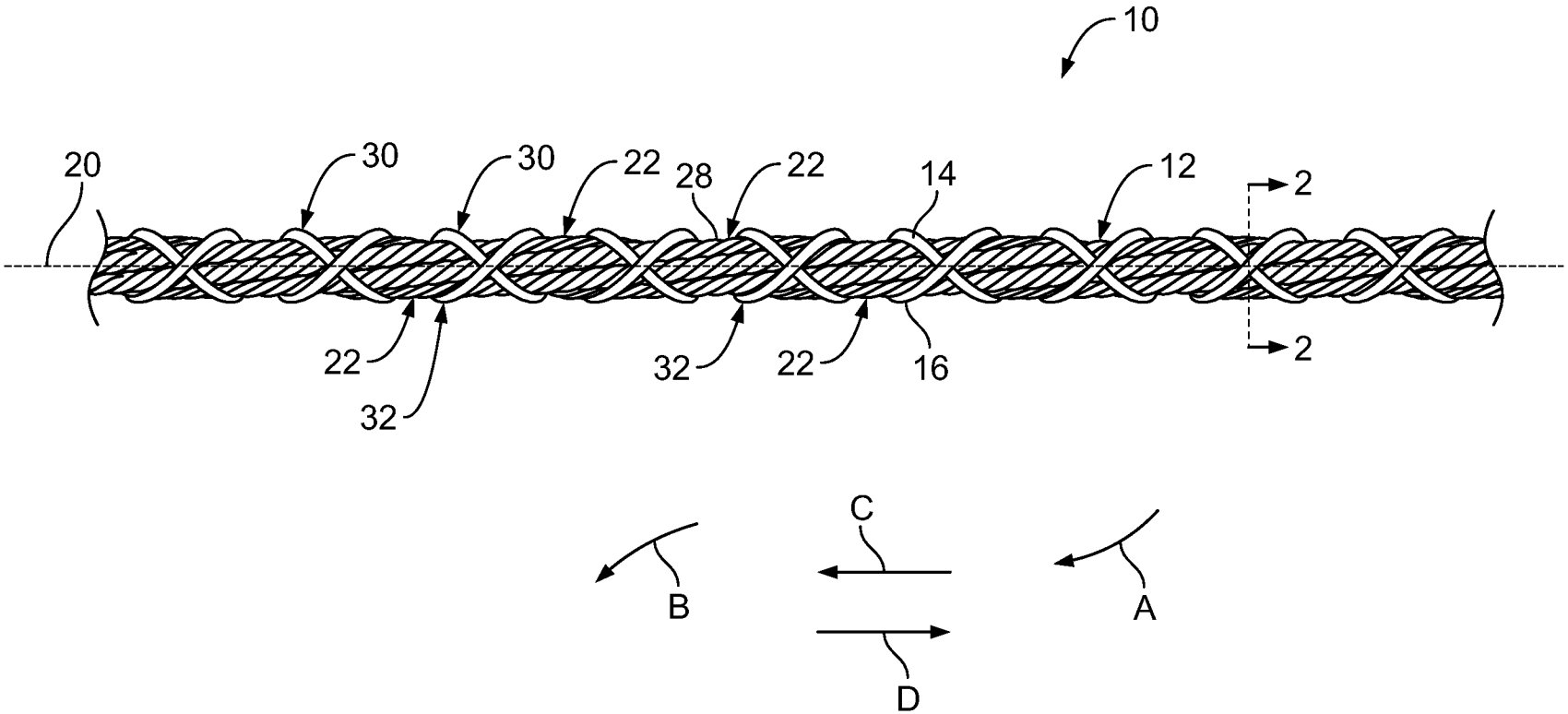
FIG. 1 is a perspective view of a portion of an exemplary embodiment of a cable.
Figure 2:
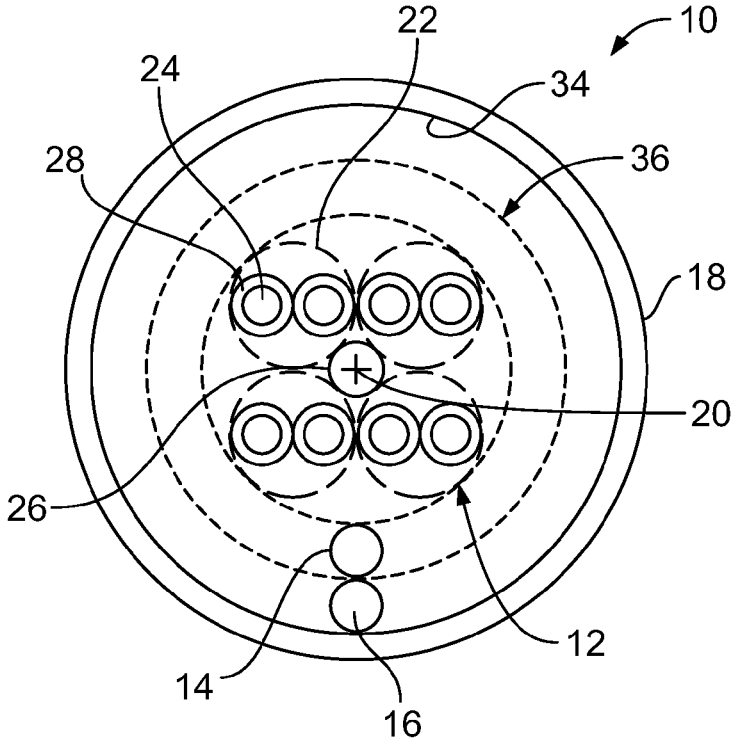
FIG. 2 is a cross section of the cable shown in FIG. 1 taken along line 2-2 of FIG. 1.

FIG. 1 is a perspective view of a portion of an exemplary embodiment of a cable 10. FIG. 2 is a cross section of the cable shown in FIG. 1 taken along line 2-2 of FIG. 1. In the description that follows, the cable 10 will be described and/or illustrated in terms of premise cabling, such as, but not limited to, a data communication cable and/or the like. However, it is to be understood that the subject matter described and/or illustrated herein are also applicable to other types of cables, including, but not limited to, wires, cords, cables, and/or the like of any type. The following description and illustrations are therefore provided for illustrative purposes only and are but one potential application of the subject matter described and/or illustrated herein.

The cable 10 includes a central core 12, inner and outer filler elements 14 and 16, respectively, and a jacket 18. The jacket 18 has been removed from FIG. 1 for clarity. The central core 12 extends a length along a central longitudinal axis 20. The inner filler element 14 and the outer filler element 16 extend around the central core 12. The jacket 18 extends around the inner and outer filler elements 14 and 16, respectively. As will be described below, the outer filler element 16 is wrapped around the inner filler element 14, and the filler elements 14 and 16 extend between the central core 12 and the jacket 18 to space at least a portion of the central core 12 apart from the jacket 18.

The central core 12 includes a group of a plurality of twisted pairs 22 of insulated conductors 24 (not visible in FIG. 1), and an optional central filler element 26 (not visible in FIG. 1). Each conductor 24 is surrounded by an insulative layer 28. The central filler element 26 extends between the twisted pairs 22. In other words, the twisted pairs 22 extend around the central filler element 26. Optionally, the central core 12 includes a binder element (not shown) that extends around the group of twisted pairs 22 to hold the twisted pairs 22 together around the central filler element 26 (or around the central longitudinal axis 20 if the central filler element 26 is not included). The binder element is wrapped around the twisted pairs 22 to thereby hold the twisted pairs 22 together in the group, with the binder element forming the radially-outermost (relative to the central longitudinal axis 20) component of the central core 12. The binder element may be fabricated from any materials, structures, and/or the like, such as, but not limited to, a dielectric tape and/or the like. The materials, structures, and/or the like of the binder element may be selected to comply with any applicable fire safety standards. In the exemplary embodiment, the two insulated conductors 24 of each twisted pair 22 are twisted around each other in a clockwise direction, as indicated by the arrow A in FIG. 1. The clockwise wrapping direction A is commonly referred to as a "right hand lay direction". Alternatively, the two insulated conductors 24 of one or more of the twisted pairs 22 are twisted around each other in a counter-clockwise direction indicated by the arrow B in FIG. 1. For example, in some embodiments, the two insulated conductors 24 of one of the twisted pairs 22 are twisted around each other in the clockwise direction A, while the two insulated conductors 24 of another twisted pair 22 are twisted around each other in the counter-clockwise direction B. The counter-clockwise wrapping direction B is commonly referred to as a "left hand lay direction". The clockwise direction may be referred to herein as a "first direction" and/or a "second direction." The counter-clockwise direction may be referred to herein as a "first direction" and/or a "second direction."

Referring again to FIG. 1, in the exemplary embodiment, the twisted pairs 22 of the central core 12 extend along helical paths around the central filler element 26 and the central longitudinal axis 20. In other words, each of the twisted pairs 22 is wound into winding turns that extend around the central filler element 26 and the central longitudinal axis 20. In the exemplary embodiment, the twisted pairs 22 are wrapped around the central filler element 26 in the clockwise direction A. Alternatively, one or more of the twisted pairs 22 is wrapped around the central filler element 26 in the counter-clockwise direction B. The winding turns of the twisted pairs 22 are interleaved between each other in the exemplary embodiment. In an alternative embodiment, one or more of the twisted pairs 22 extends along a path that is parallel to the central longitudinal axis 20 of the central core 12 instead of the helical path shown in FIG. 1. In embodiments wherein the central filler element 26 is not included, each of the twisted pairs 22 may extend along a helical path around the central longitudinal axis 20 or may extend along a parallel path to the axis 20. Although four twisted pairs 22 are shown, the central core 12 may include any number of the twisted pairs 22.

The inner filler element 14 is wrapped in a helical configuration around a periphery of the twisted pairs 22 of the central core 12. The inner filler element 14 is shaped as a coil. Specifically, the inner filler element 14 is wound into winding turns 30 that extend around the periphery of the twisted pairs 22. The winding turns 30 of the inner filler element 14 extend along helical paths around the periphery of the twisted pairs 22 of the central core 12. In embodiments wherein the binder element is included, the winding turns 30 of the inner filler element 14 extend around a periphery of the binder element such that the binder element extends between the twisted pairs 22 and the inner filler element 14.

In the exemplary embodiment, the winding turns 30 of the inner filler element 14 are wrapped around the central core 12 in the counter-clockwise direction B. Alternatively, the winding turns 30 of the inner filler element 14 are wrapped around the central core 12 in the clockwise direction A. The exemplary inner filler element 14 is wrapped around the central core 12 in an opposite direction B to the direction A that the twisted pairs 22 are wrapped around the central filler element 26. Alternatively, the inner filler element 14 is wrapped around the central core 12 in the same direction as the twisted pairs 22.

The winding turns 30 of the inner filler element 14 are angled relative to the central longitudinal axis 20 in a direction indicated by the arrow C in FIG. 1. The angle of the winding turns 30 relative to the central longitudinal axis 20 is commonly referred to as a "lay angle". In some alternative embodiments, the winding turns 30 of the inner filler element 14 are angled relative to the central longitudinal axis 20 in an opposite direction indicated by the arrow D in FIG. 1. The winding turns 30 of the inner filler element 14 may have any lay angle relative to the central longitudinal axis 20. In the exemplary embodiment, the lay angle is consistent along the length of the winding turns 30 such that the winding turns 30 are evenly spaced along the length of the central core 12. Alternatively, the lay angle of the winding turns 30 is variable along the length of the central core 12.

Similar to the inner filler element 14, the outer filler element 16 is also wrapped in a helical configuration around the periphery of the twisted pairs 22 of the central core 12. The outer filler element 16 is shaped as a coil having winding turns 32 that extend around the periphery of the twisted pairs 22. The winding turns 32 of the outer filler element 16 extend along helical paths around the periphery of the twisted pairs 22 of the central core 12. The outer filler element 16 is wrapped over the inner filler element 14 such that the inner filler element 14 extends between the central core 12 and the outer filler element 16. In other words, the winding turns 32 of the outer filler element 16 are wrapped over the winding turns 30 of the inner filler element 14 in engagement therewith. In an alternative embodiment, the cable 10 does not include the inner filler element 14 or does not include the outer filler element 16, such that only one filler element 14 or 16 extends between the central core 12 and the jacket 18 (FIG. 1).

Optionally, the winding turns 32 of the outer filler element 16 are wrapped around the central core 12 in an opposite direction to the winding turns 30 of the inner filler element 14. For example, in the exemplary embodiment, the winding turns 32 of the outer filler element 16 are wrapped in the clockwise direction A while the winding turns 30 of the inner filler element 14 are wrapped in the counter-clockwise direction B, as can be seen in FIG. 1. In an alternative embodiment, the winding turns 32 of the outer filler element 16 are wrapped in the counter-clockwise direction B, whether or not the winding turns 30 of the inner filler element 14 are wrapped in the direction A or the direction B. In the exemplary embodiment, the outer filler element 16 is wrapped around the central core 12 in the same direction A as the direction that the twisted pairs 22 are wrapped around the central filler element 26. Alternatively, the outer filler element 16 is wrapped around the central core 12 in an opposite direction to the twisted pairs 22.

The winding turns 32 of the outer filler element 16 are angled relative to the central longitudinal axis 20 in a direction indicated by the arrow D. Alternatively, the winding turns 32 of the outer filler element 16 are angled relative to the central longitudinal axis 20 in the opposite direction C. The winding turns 32 of the outer filler element 16 may have any lay angle relative to the central longitudinal axis 20. In the exemplary embodiment, the lay angle is consistent along the length of the winding turns 32 such that the winding turns 32 are evenly spaced along the length of the central core 12. Alternatively, the lay angle of the winding turns 32 is variable along the length of the central core 12. Optionally, the spacing between the winding turns 32 of the outer filler element 16 is approximately the same as the spacing between the winding turns 30 of the inner filler element 14. Moreover, the winding turns 32 of the outer filler element 16 optionally have the same lay angle as the winding turns 30 of the inner filler element 14, as is shown in FIG. 1.

Referring again to FIG. 2, the helical paths of the filler elements 14 and 16 facilitate providing the cable 10 with a circular cross-sectional shape. The inner and outer filler elements 14 and 16, respectively, extend between the central core 12 and the jacket 18. The filler elements 14 and 16 thereby space the twisted pairs 22 apart from the jacket 18. In other words, the inner filler element 14 and the outer filler element 16 create an air gap 36 between an interior surface 34 of the jacket 18 and the periphery of the twisted pairs 22 (or between the surface 34 and the binder element when the binder element is included). The filler elements 14 and 16 thereby increase the distance between the twisted pairs 22 and other items (not shown) outside the cable 10, such as, but not limited to, a twisted pair (not shown) of another cable (not shown) and/or the like. Spacing the twisted pairs 22 from the jacket 18 may also reduce or eliminate loss between the twisted pairs 22 the jacket 18. The filler elements 14 and 16 may each have any size for providing an size air gap 36. For example, the inner and outer filler elements 14 and 16, respectively, may each have, but are not limited to, a cross-sectional size (e.g., diameter) between approximately 0.030 inches and approximately 0.090 inches.

In the exemplary embodiment, each of the filler elements 14, 16, and 26 is solid along the length thereof and has a circular cross-sectional shape. But, the filler elements 14, 16, and 26 are not limited to being solid, nor are the filler elements 14, 16, and 26 limited to the circular cross-sectional shape. Rather, the inner filler element 14, the outer filler element 16, and the central filler element 26 may each include any other shape and may each be hollow along at least a portion of the length thereof. Although not shown herein, in some embodiments, the central filler element 26 has an approximately planar, or flat, shape.

Figure 3:
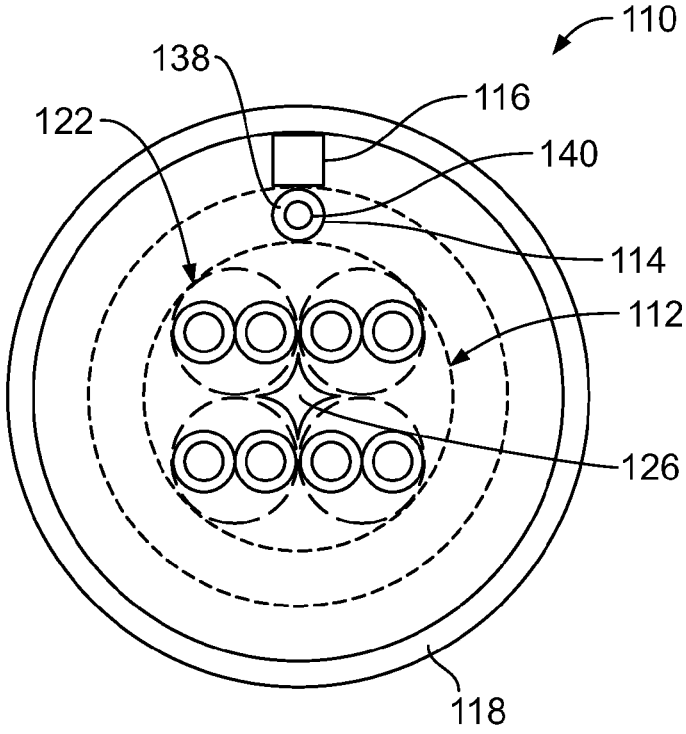
FIG. 3 is a cross-sectional view of an exemplary alternative embodiment of a cable.

FIG. 3 is a cross-sectional view of an exemplary alternative embodiment of a cable 110 illustrating a hollow filler element 114 and filler elements 116 and 126 that include different shapes than the filler elements 16 (FIGS. 1 and 2) and 26 (FIG. 2), respectively. The cable 110 includes a central core 112, inner and outer filler elements 114 and 116, respectively, and a jacket 118. The central core 112 includes a central filler element 126 and twisted pairs 122 extending around the central filler element 126. The inner filler element 114 and the outer filler element 116 are wrapped helically around the central core 112. The filler element 114 and 116 are shaped as coils having winding turns that extend around the twisted pairs 122 of the central core 112. The jacket 118 extends around the filler elements 114 and 116 and the central core 112. The outer filler element 116 is wrapped around the inner filler element 114.

The inner filler element 114 is hollow along at least a portion of the length thereof. More particularly, the inner filler element 114 includes a cylindrical shape defined by a circular wall 138 having a central opening 140 extending therethrough 140. The central opening 140 extends through the wall 138 along at least a portion of the length of the wall 138. The outer filler element 116 includes a rectangular cross-sectional shape defined by four exterior surfaces of the outer filler element 116. The central filler element 126 includes the cross-sectional shape of an astroid.

Referring again to FIG. 2, the filler elements 14, 16, and 26 may each be fabricated from any materials, such as, but not limited to, a fluoropolymer, polyvinyl chloride (PVC), a fire resistant material, fluorinated ethylene propylene (FEP), polyethylene (PE), fire resistant polyethylene (FRPE), and/or the like. In some embodiments, the central filler element 26 is fabricated from a flat tape, such as, but not limited to, an aluminum tape, an aluminum/polyester tape, and/or the like. The conductors 24 of the twisted pairs 22 may be fabricated from any conductive materials, such as, but not limited to, bare copper, tined plated copper, silver plated copper, and/or the like. Each conductor 24 may be formed from any number of strands of material. The insulative layers 28 are fabricated from any insulative, non-conductive materials, such as, but not limited to, polypropylene, FEP, polytetrafluoroethylene-perfluoromethylvinylether (MFA), PE, and/or the like. The jacket 18 may be fabricated from any at least partially dielectric materials, such as, but not limited to, a polymer, PVC, low smoke zero halogen PVC, FEP, polyvinylidene fluoride (PVDF), PE, and/or the like.

Figure 4:
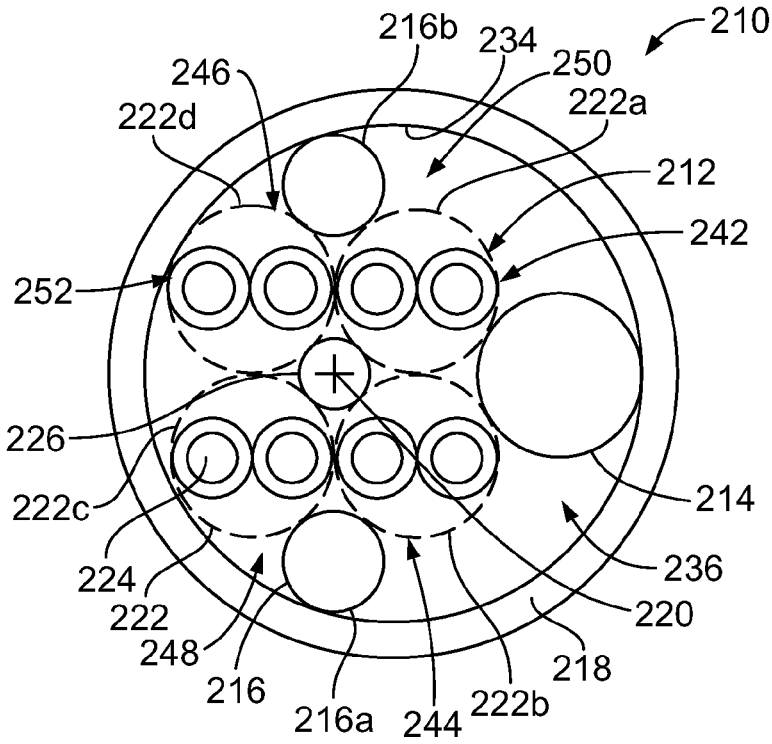
FIG. 4 is a cross-sectional view of another exemplary alternative embodiment of a cable.

FIG. 4 is a cross-sectional view of another exemplary alternative embodiment of a cable 210. The cable 210 includes a central core 212, filler elements 214 and 216, and a jacket 218. The filler elements 214 and 216 extend around the central core 212. The jacket 218 extends around the filler elements 214 and 216 and the central core 212. The central core 212 extends a length along a central longitudinal axis 220 and includes a group of a plurality of twisted pairs 222 of insulated conductors 224, and an optional central filler element 226 extending between the twisted pairs 222. The central core 212 optionally includes a binder element (not shown) that extends around the group of twisted pairs 222. In the exemplary embodiment, each twisted pair 222 extends parallel to the central longitudinal axis 220 along the length of the cable 210. Alternatively, the twisted pairs 222 extend along helical paths around the central longitudinal axis 220. Although only a single filler element 214 is shown, and two filler elements 216*a* and 216*b* are shown, the cable 210 may include any number of the filler elements 214 and any number of the filler elements 216. The filler element 214 may be referred to herein as a "first filler element" and/or a "second filler element". Each of the filler elements 216 may be referred to herein as a "first filler element" and/or a "second filler element".

The filler element 214 extends between the jacket 218 and the twisted pairs 222 of the central core 212. In the exemplary embodiment, the filler element 214 extends parallel to the central longitudinal axis 220 along the length of the cable 210. Alternatively, the filler element 214 extends along a helical path around the central core 212. Each filler element 216*a* and 216*b* also extends between the jacket 218 and the twisted pairs 222 of the central core 212. Similar to the filler element 214, the exemplary filler elements 216 extend parallel to the central longitudinal axis 220 along the length of the cable 210, however each filler element 216 may alternatively extend along a helical path around the central core 212.

The filler element 214 extends between the central core 212 and the jacket 218. The filler element 214 spaces a side 242 of the central core 212 apart from the jacket 18. In other words, the filler element 214 creates an air gap 236 between two of the twisted pairs 222*a* and 222*b* and an interior surface 234 of the jacket 218. Each of the filler elements 216*a* and 216*b* extends between a respective side 244 and 246 of the central core 212 and the jacket 218. The filler elements 216*a* and 216*b* space the sides 244 and 246 of the central core 212 apart from the jacket 218 to create respective air gaps 248 and 250 between the interior surface 234 of the jacket 218 and the sides 244 and 246 of the central core 212. A side 252 of the central core 212 is engaged with the interior surface 234 of the jacket 218. Specifically, twisted pairs 222*c* and 222*d* of the central core 212 are engaged with the interior surface 234 of the jacket 218 along the side 252. Accordingly, the filler elements 214 and 216 space only some of the twisted pairs 222 of the central core 212 apart from the jacket 218. The filler elements 214, 216*a*, and 216*b* increase the distance between the sides 242, 244, and 246, respectively, of the central core 212 and other items (not shown) outside the cable 210 that extend along the sides 242, 244, and/or 246. The arrangement of the filler elements 214 and 216 and the central core 212 within the jacket 218, as well as the relative sizes of the filler elements 214 and 216, provides the cable 210 with a circular cross-sectional shape.

As can be seen in FIG. 4, the filler element 214 has a greater cross-sectional size (e.g., diameter) than each of the filler elements 216*a* and 216*b*. Accordingly, the air gap 236 is larger than the air gaps 248 and 250. The distance between the side 242 of the central core 212 and another item that extends outside the cable 210 along the side 242 is thereby greater than the distances between the sides 244 and 246 and items that extends outside the cable 210 along the side 244 and 246. The cable 210 may therefore provide more protection against alien crosstalk along the side 242 of the central core 212 than along the sides 244, 246, and 252.

Figure 5:
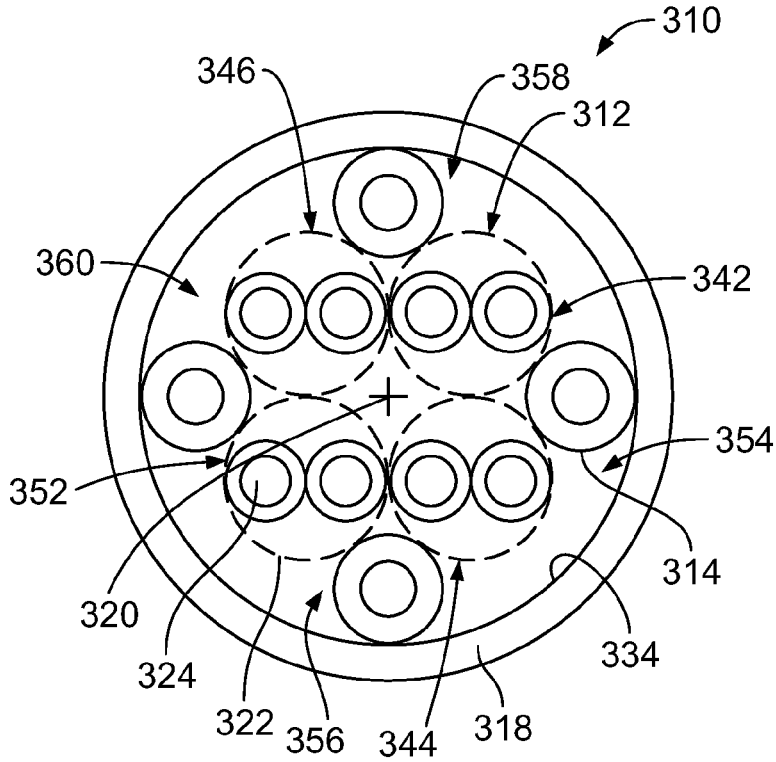
FIG. 5 is a cross-sectional view of yet another exemplary alternative embodiment of a cable.

FIG. 5 is a cross-sectional view of yet another exemplary alternative embodiment of a cable 310. The cable 310 includes a central core 312, a plurality of filler elements 314, and a jacket 318. The filler elements 314 extend around the central core 312, and the jacket 318 extends around the filler elements 314. The central core 312 extends a length along a central longitudinal axis 320 and includes a group of a plurality of twisted pairs 322 of insulated conductors 324. The central core 312 optionally includes a binder element (not shown) that extends around the group of twisted pairs 322. In the exemplary embodiment, each twisted pair 322 extends parallel to the central longitudinal axis 320 along the length of the cable 310. Alternatively, the twisted pairs 322 extend along helical paths around the central longitudinal axis 320. The cable 310 may include any number of the filler elements 314.

In the exemplary embodiment, the filler elements 314 extend parallel to the central longitudinal axis 320 along the length of the cable 310. Alternatively, one or more of the filler elements 314 extends along a helical path around the central core 312. The filler elements 314 are spaced apart about the periphery of the central core 312 such that each filler element 314 extends between an interior surface 334 of the jacket 318 and a corresponding side 342, 344, 346, and 352 of the central core 312. The filler elements 314 create respective air gaps 354, 356, 358, and 360 between the sides 342, 344, 346, and 352 of the central core 312 and the interior surface 334 of the jacket 318. Each filler element 314 thereby spaces two corresponding twisted pairs 322 of the central core 312 apart from the jacket 318. The filler elements 314 increase the distance between the sides 342, 344, 346, and 352 of the central core 312 and other items (not shown) outside the cable 310. As can be seen in FIG. 5, the arrangement of the filler elements 314 around the central core 312, as well as providing the filler elements 314 with the same approximate cross-sectional size, provides the cable 310 with a circular cross-sectional shape.

The embodiments described and/or illustrated herein may provide a cable having an improved electrical performance as compared with at least some known cables. For example, the embodiments described and/or illustrated herein may provide a cable having a reduced amount of crosstalk and/or an increased amount of crosstalk isolation than at least some known cables. The embodiments described and/or illustrated herein may provide a cable that experiences a reduced amount of alien crosstalk but has less flammable mass than at least some known cables. The embodiments described and/or illustrated herein may provide a cable that includes filler elements with a circular cross-sectional shape.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable comprising:

twisted pairs of insulated conductors, each twisted pair comprising two insulated conductors twisted together in a helical manner, the twisted pairs being grouped together to define a central core of the cable, the central core comprising a central longitudinal axis, the twisted pairs extending along helical paths around the central longitudinal axis in a first direction;

a jacket at least partially surrounding the central core;

an inner filler element wrapped helically around the twisted pairs of the central core between the central core and the jacket; and an outer filler element extending between the central core and the jacket, the outer filler element being wrapped helically around the twisted pairs of the central core and over the inner filler element such that the inner and outer filler elements create an air gap between the jacket and the central core, wherein the inner and outer filler elements are wound into winding turns that extend around the twisted pairs of the central core, and wherein the winding turns of at least one of the inner filler element or the outer filler element are wrapped around the twisted pairs in a second direction that is opposite the first direction.

2. The cable according to claim 1, wherein the inner and outer filler elements are wound into winding turns that extend around the twisted pairs of the central core, the winding turns of the inner filler element being wrapped around the twisted pairs with approximately the same lay angle as the winding turns of the outer filler element.

3. The cable according to claim 1, wherein the central core comprises a central longitudinal axis, the twisted pairs extending along helical paths around the central longitudinal axis.

4. The cable according to claim 1, wherein the central core further comprises a central filler element extending between the twisted pairs such that the twisted pairs extend around the central filler element.

5. The cable according to claim 1, wherein at least one of the inner filler element or the outer filler element comprises a circular cross-sectional shape.

6. The cable according to claim 1, wherein at least one of the inner filler element or the outer filler element is hollow.

7. The cable according to claim 1, wherein the cable comprises a circular cross-sectional shape.

8. The cable according to claim 1, wherein at least one of the inner filler element or the outer filler element comprises a rectangular cross-sectional shape.

9. A cable comprising:

twisted pairs of insulated conductors, each twisted pair comprising two insulated conductors twisted together in a helical manner, the twisted pairs being grouped together to define a central core of the cable;

a jacket at least partially surrounding the central core, an inner filler element wrapped helically around the twisted pairs of the central core between the central core and the jacket; and an outer filler element extending between the central core and the jacket, the outer filler element being wrapped helically around the twisted pairs of the central core and over the inner filler element such that the inner and outer filler elements create an air gap between the jacket and the central core, wherein the inner and outer filler elements are wound into winding turns that extend around the twisted pairs of the central core, the winding turns of the inner filler element being wrapped around the twisted pairs in a clockwise direction, the winding turns of the outer filler element being wrapped around the twisted pairs of the central core in a counter-clockwise direction.

10. A cable comprising:

twisted pairs of insulated conductors, each twisted pair comprising two insulated conductors twisted together in a helical manner, the twisted pairs being grouped together to define a central core of the cable;

a jacket at least partially surrounding the central core;

a first filler element extending between the central core and the jacket, the first filler element being a discrete component from the jacket; and a second filler element extending between the central core and the jacket, the second filler element being a discrete component from the jacket, wherein the second filler element has a greater cross-sectional size than the first filler element, wherein the first and second filler elements are engaged between the central core and the jacket such that the cable comprises a circular cross-sectional shape, and wherein the first and second filler elements extend between the central core and the jacket such that at least one of the twisted pairs is spaced apart from the jacket and at least one of the twisted pairs is engaged with the jacket.

11. The cable according to claim 10, wherein the second filler element has a greater diameter than the first filler element.

12. The cable according to claim 11, wherein at least one of the first filler element or the second filler element is hollow.

13. The cable according to claim 11, wherein at least one of the first filler element or the second filler element comprises a circular cross-sectional shape.

14. The cable according to claim 10, wherein the first and second filler elements are wound into winding turns that extend around the twisted pairs of the central core.

15. The cable according to claim 10, wherein the central core further comprises a central filler element extending between the twisted pairs such that the twisted pairs extend around the central filler element.

16. The cable according to claim 10, wherein the first and second filler elements are wrapped helically around the twisted pairs of the central core.

17. A cable comprising:

twisted pairs of insulated conductors, each twisted pair comprising two insulated conductors twisted together in a helical manner, the twisted pairs being grouped together to define a central core of the cable, wherein the central core extends a length along a central longitudinal axis;

a jacket at least partially surrounding the central core;

a first filler element extending between the central core and the jacket, the first filler element being a discrete component from the jacket; and a second filler element extending between the central core and the jacket, the second filler element being a discrete component from the jacket, wherein the second filler element has a greater cross-sectional size than the first filler element, and wherein the first and second filler elements are engaged between the central core and the jacket such that the cable comprises a circular cross-sectional shape, the first and second filler elements extending parallel to the central longitudinal axis along the length of the cable.

* * * * *